US007665825B2

(12) United States Patent
Kaneko

(10) Patent No.: US 7,665,825 B2
(45) Date of Patent: Feb. 23, 2010

(54) INK JET RECORDING HEAD, INK JET RECORDING APPARATUS, AND METHOD OF MANUFACTURING INK JET RECORDING HEAD

(75) Inventor: Mineo Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 384 days.

(21) Appl. No.: 11/760,946

(22) Filed: Jun. 11, 2007

(65) Prior Publication Data

US 2008/0001994 A1 Jan. 3, 2008

(30) Foreign Application Priority Data

Jul. 3, 2006 (JP) ..... 2006-183256

(51) Int. Cl.
*B41J 2/145* (2006.01)
*B41J 2/15* (2006.01)

(52) U.S. Cl. ..... 347/40; 347/65

(58) Field of Classification Search ..... 347/40–43, 347/47, 65, 71

See application file for complete search history.

(56) References Cited

U.S. PATENT DOCUMENTS 5,208,605 A 5/1993 Drake
5,478,606 A 12/1995 Ohkuma et al.
6,286,933 B1 9/2001 Murakami et al.
6,575,560 B2 6/2003 Kaneko et al.
6,592,202 B2 7/2003 Udagawa et al.
6,652,079 B2 * 11/2003 Tsuchii et al. ..... 347/65
6,659,591 B2 12/2003 Sato et al.
6,830,317 B2 12/2004 Tsuchii et al.
6,964,467 B2 11/2005 Kaneko et al.
6,988,786 B2 1/2006 Kaneko et al.
2007/0035580 A1 2/2007 Ide et al.
2008/0012898 A1 1/2008 Tsuchii et al.
2008/0055368 A1 3/2008 Oikawa et al.
2008/0143786 A1 6/2008 Oikawa et al.

* cited by examiner

*Primary Examiner*—Thinh H Nguyen
(74) *Attorney, Agent, or Firm*—Fitzpatrick, Cella, Harper & Scinto

(57) ABSTRACT

An ink jet recording head includes a first ink flow path array corresponding to a first recording element array, and a distance (La) between one end portion of an ink flow path and another end portion thereof across a first ink supply opening in the first ink flow path array is substantially equal to a distance (Lb) between one end portion of an ink flow path corresponding to a recording element located relatively far from a second supply opening and another end portion thereof across the second ink supply opening in a second ink flow path array.

13 Claims, 7 Drawing Sheets

INK JET RECORDING HEAD, INK JET RECORDING APPARATUS, AND METHOD OF MANUFACTURING INK JET RECORDING HEAD

BACKGROUND OF THE INVENTION

1. Field of the Invention

The present invention relates to an ink jet recording head for recording on a recording medium by discharging ink, an ink jet recording apparatus, and a method of manufacturing the ink jet recording head.

2. Description of the Related Art

A basic performance of an ink jet printer largely depends on its image quality and high speed performance. In order to improve the image quality, it is necessary to reduce ink droplets in size as small as possible, and desirably set the size thereof to about 1 pl or less, which is above a visible limit, on a paper surface. On the other hand, in order to obtain the high speed performance, it is necessary to increase an amount of ink applied to a medium within a predetermined period of time. In order to accomplish this by using small-size liquid droplets, it is necessary to increase density of each recording element and increase a response frequency, which has limitations in terms of structure and fluid. As a method of solving the problem, U.S. Pat. No. 5,208,605 proposes a technique of providing multiple discharge ports for discharging different sizes of liquid droplets to one recording head.

Further, U.S. Pat. No. 5,478,606, for example, discloses a method of forming such a fine discharge port and an ink flow path having high density. U.S. Pat. No. 5,478,606 proposes a method of forming a flow path such that the ink flow path is formed by using a photosensitive resin, another photosensitive resin is applied thereonto and dried to form a discharge port, and then the first photosensitive resin is removed. According to the method, both the flow path and the discharge port are formed by exposure, so it is possible to process them finely and with high density.

With regard to the ink jet recording head having multiple sizes of liquid droplets as described above, it is more advantageous for obtainment of higher density to arrange an array of nozzles for discharging small liquid droplets separately from an array of nozzles for discharging large liquid droplets. In order to pursue the higher density of each nozzle, it is most advantageous to arrange the nozzles for small liquid droplets in a staggered manner with density twice as much as that of the nozzles for large liquid droplets.

However, when another resin is applied onto the resin formed in a shape of an ink flow path, a thickness of the resin is not completely uniform, and the thickness has variation due to effects such as viscosity of the resin, surface tension, and solid content density. A portion of the ink flow path with higher density has a wider area for the flow path, so the thickness of the resin of the flow path member formed on the corresponding portion becomes thicker than the other portions for large liquid droplets. As a result, the discharge resistance is increased and the discharge efficiency is lowered, and thus a discharge failure is liable to occur.

FIGS. 8A to 8C are plan views and cross-sectional diagrams taken along the line A-A of a conventional recording head.

In the prior art, a distance Lb between one end of a flow path 510 for discharging small liquid droplets and the other end thereof is 360 μm, and recording elements 506 are arranged in a staggered manner at 1200 dpi (interval of 21 μm). On the other hand, a distance La between one end of a flow path 510 for discharging large liquid droplets and the other end thereof is 280 μm, and recording elements 506 are arranged in a staggered manner at 600 dpi (interval of 42 μm). Thus, the distance La of the flow path for large liquid droplets is 280 μm, and the distance Lb of the flow path for small liquid droplets in which an arrangement density of the recording elements 506 is high is 360 μm, which is about 1.3 times as long as the distance La. The recording head includes driving circuits 521, a substrate 523, and a flow path resin 525.

Therefore, according to the prior art, a flow path member 508 has a difference dh in thickness which is 2 μm at maximum. This indicates that a difference in resistance of 20% is generated when it is assumed that a thickness of the discharge port portion is 10 μm, and some effects are shown, for example, deviation of each placement position of small liquid droplets and large liquid droplets on a paper surface due to a difference between discharge speeds thereof, especially at the time of recording of a high resolution image.

On the other hand, in a case of optimizing the thickness of the resin so as to discharge small liquid droplets, the thickness of the resin corresponding to the portion of the flow path for large liquid droplets is reduced, with the result that deformation or the like of the resin due to strength degradation is liable to occur.

SUMMARY OF THE INVENTION

Therefore, it is an object of the present invention to provide an ink jet head capable of keeping a resin thickness of a flow path member uniform and of obtaining an excellent discharge characteristic irrespective of a density of a recording element.

In order to attain the above-mentioned object, an ink jet recording head according to the present invention includes a substrate on which at least two ink supply openings and a plurality of recording elements arranged in rows at a predetermined interval on both sides of the ink supply openings are formed. The ink jet recording head according to the present invention further includes an ink flow path for guiding ink from each ink supply opening to each recording element provided on both sides thereof. Specifically, the ink jet recording head according to the present invention includes one recording element array and the other recording element array formed of, at least one of both sides of one of said ink supply openings, a recording element located relatively closer to said supply opening and a recording element located relatively far from said supply opening arranged in a staggered manner at an arrangement interval narrower than those of the recording elements of the one recording element array. In the ink jet recording head according to the present invention, one ink flow path array corresponds to the one recording element array, and the other ink flow path array corresponds to the other recording element array, and a distance (La) between one end portion of the ink flow path and the other end portion thereof across the ink supply opening in said one ink flow path array is substantially equal to a distance (Lb) that is longest among distances between one end portion of the ink flow path corresponding to the recording element located relatively far from said supply opening and the other end portion thereof across the ink supply opening in the other ink flow path array.

According to the present invention, it is possible to maintain a resin thickness of a flow path forming member to be uniform irrespective of the density of the recording elements, and to obtain an excellent discharge characteristic.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the attached drawings.

Embodiment 1

Figure 1C:
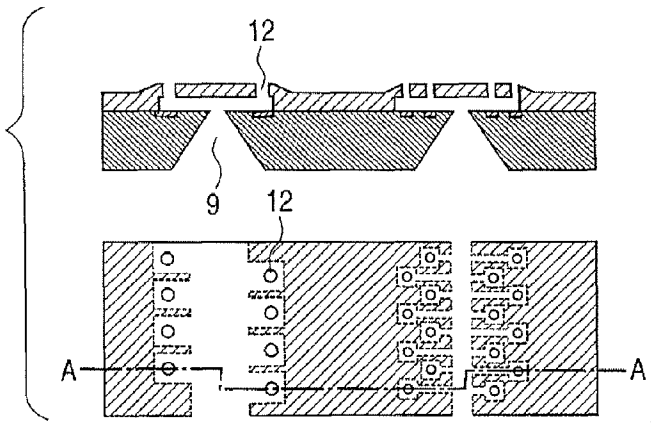
FIGS. 1A, 1B, 1C and 1D are plan views and cross-sectional diagrams taken along the line A-A of an ink jet recording head according to a first embodiment of the present invention, and each illustrates a process for forming the ink jet recording head.
Figure 1D:
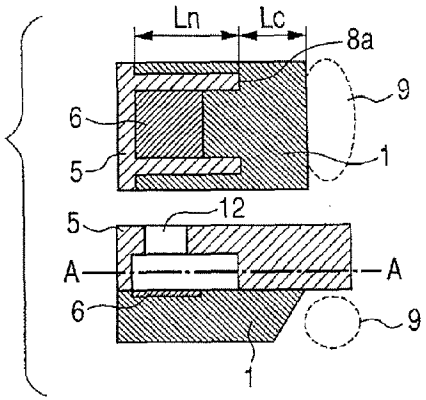

FIGS. 1A to 1D are plan views and cross-sectional diagrams taken along the line A-A of an ink jet recording head according to a first embodiment of the present invention, and each illustrates a process for forming the ink jet recording head. Further, FIG. 1D illustrates a plan view and a cross-sectional diagram taken along the line A-A of the vicinity of a discharge opening for discharging large-size liquid droplets.

A recording head 1 according to this embodiment includes a large liquid droplet flow path group 2 constituted by flow paths for discharging large liquid droplets, and a small liquid droplet flow path group 3 in which flow paths for discharging small liquid droplets are arranged in a staggered manner. A distance between one outermost end of each flow path of the large liquid droplet flow path group 2 and the other outermost end thereof is substantially equal to that of the small liquid droplet flow path group 3 (distance La=distance Lb). As a result, an applied thickness of a flow path member for large liquid droplets becomes equal to that for small liquid droplets, thereby providing an ink jet head with high image quality, high speed performance, and high reliability.

Hereinafter, the structure of the recording head 1 will be described in detail.

Figure 1A:
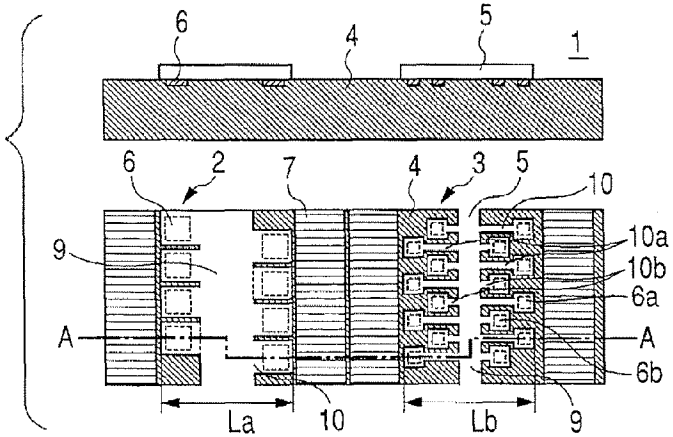

Referring to FIG. 1A, in order to form the recording head 1, a positive-type photoresist is first applied onto a substrate 4 on which recording elements 6 are formed. Then, portions which become flow paths 10 afterwards are formed by exposure and development. A thickness of the photoresist is desirably set within a range of 10 μm to 15 μm in view of flow path resistance and the like. Control of the thickness can be performed by adjustment of viscosity at the time of application and an application speed. A silicon substrate is generally used as the substrate 4 because the recording elements 6 can be formed thereon with high density and driving circuits 7 (MOS transistors) for driving each recording element 6 can be formed thereon.

Each recording element 6 is formed of a heating resistive element such as tantalum nitride and is covered with an inorganic protective film resistant to ink, such as silicon nitride, or covered with a metal protective film such as tantalum. In the recording elements 6, there are provided the small liquid droplet flow path group 3 for discharging small liquid droplets so as to obtain high image quality, and the large liquid droplet flow path group 2 for discharging large liquid droplets so as to obtain high speed printing, respectively. By application of an electric signal to each recording element 6 from the driving circuit 7, ink provided in the vicinity of the recording element 6 is rapidly boiled, and ink droplets are discharged from discharge ports 12 due to the rapid growth of bubbles of ink generated by phase change of the ink at that time.

The small liquid droplet flow path group 3 forms a dot of about 20 μm which is the visible limit on a paper surface, so the recording elements 6 for discharging ink of about 1 pl are desirably arranged at 1200 dpi (interval of 21 μm). For this reason, each recording element 6 is preferred to have a shape of a square with one side of 15 μm to 17 μm, or a rectangular having an equivalent area to the square. In order to arrange the recording elements 6 at 1200 dpi, it is preferable to arrange the recording elements relatively close to the supply opening and recording elements relatively far from the supply opening in a staggered manner.

In this embodiment, another group of those recording elements 6 is formed at a position substantially axisymmetrically with respect to an ink supply opening 9. The ink supply opening 9 is formed in a substantially final step of this process, and is formed by being etched from a surface of the substrate 4 opposite to a surface thereof on which the recording elements 6 are formed. A distance between the two groups of recording element arrays is determined by flow resistance of the supply port, processing accuracy, and a length of the flow path. The distance is desirably an integral multiple of 1200 dpi for convenience of signal processing, and more desirably an integral multiple of 600 dpi. In this embodiment, a distance between recording elements located on a side close to the supply openings of the recording element array was set to 254 μm which corresponds to 6 pixels at 600 dpi. A distance between a recording element array which is close to the ink supply opening 9 and a recording element array which is distant from the ink supply opening 9 was set to 42 μm which corresponds to about 1 pixel at 600 dpi (which is referred to as "the other recording element array" to be distinct from the large liquid droplet flow path group).

At this time, a distance Lb from one outermost end of the flow path 10 to the other outermost end thereof was 360 μm.

On the other hand, the large liquid droplet flow path group 2 desirably has a discharge amount within a range of 4 pl to 6 pl in view of a balance between the high speed performance and granularity obtained on a paper surface. In this embodiment, the discharge amount was set to 5.5 pl. The recording elements 6 for the large liquid droplet flow path group 2 (referred to as "one recording element array") are required to have an area with one side of about 24 μm to 26 μm. Accordingly, in staggered arrangement like the small liquid droplet flow path group 3, each flow path is extremely reduced in width, so a sufficient performance cannot be achieved and a sufficient effect cannot be obtained. Therefore, a distance between the adjacent recording elements 6 was set to 600 dpi (42 μm) and a distance between the recording element arrays provided across the ink supply opening 9 was set to 338 μm. The distance La between one end of the flow path and the other end thereof was 368 μm. In other words, since the distance Lb is 360 μm, the distance La and the distance Lb are substantially equal to each other. At this time, a distance Lc (see FIG. 1D) was set to 40 μm for the small liquid droplet flow path group 3 and was set to 82 μm for the large liquid droplet flow path group 2.

It should be noted that, according to the present invention, enlargement of an area of the flow path for large liquid droplets is achieved by increasing the distance Lc between a flow path wall end 8*a* and the ink supply opening 9. This is achieved in order to prevent increase of the flow resistance of the flow path due to increase of a flow path length Ln, and lowering of a response frequency.

Here, the above-mentioned distance La, distance Lb, distance Lc, and the flow path length Ln are described.

The distance La indicates a length of each flow path 10 which belongs to the array of flow paths in the large liquid droplet flow path group 2 (one flow path array). In FIG. 1A, the distance La indicates a distance between a wall surface of an end portion of each flow path 10 which is positioned on the left side of the ink supply opening 9, and a wall surface of an end portion of each flow path 10 which is positioned on the right side of the ink supply opening 9.

The distance Lb indicates a length of each flow path 10 which belongs to the array of flow paths in the small liquid droplet flow path group 3 (the other flow path array). The flow paths 10 for supplying ink from the supply ink opening 9 to the respective recording element 6 arranged in a staggered manner form an array of flow paths, and include flow paths 10*a* and flow paths 10*b* each having a length shorter than that of the flow path 10*a*. The recording elements 6 are arranged in a staggered manner, so the recording elements 6 include recording elements 6*a* arranged far from the ink supply opening 9, and recording elements 6*b* arranged close to the ink supply opening 9. Each flow path 10*a* is a flow path for supplying ink to each recording element 6*a* arranged at a distance from the ink supply opening 9. Each flow path 10*b* is a flow path for supplying ink to each recording element 6*b* arranged close to the ink supply opening 9. The distance Lb indicates a distance between one outermost end of the flow path 10*a* and the other outermost end thereof across the ink supply opening 9. In FIG. 1A, the distance Lb indicates a distance between a wall surface of an end portion of each flow path 10*a* which is positioned on the left side of the ink supply opening 9, and a wall surface of an end portion of each flow path 10*a* is positioned on the right side of the ink supply opening 9. In other words, the distance Lb is the longest distance among distances between an end portion of each flow path 10*a* and the other end portion thereof across the ink supply opening 9 in the small liquid droplet flow path group 3.

The distance Lc indicates a distance between the flow path wall end 8*a* which is an end portion on a side wall of each flow path 10 and the ink supply opening 9.

The distance Ln indicates a length between an end portion of each flow path 10 and the flow path wall end 8*a*.

Figure 2A:
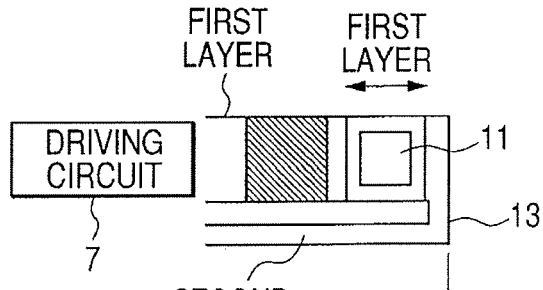
FIGS. 2A and 2B are schematic plan views for illustrating wirings in the vicinity of recording elements.
Figure 2B:
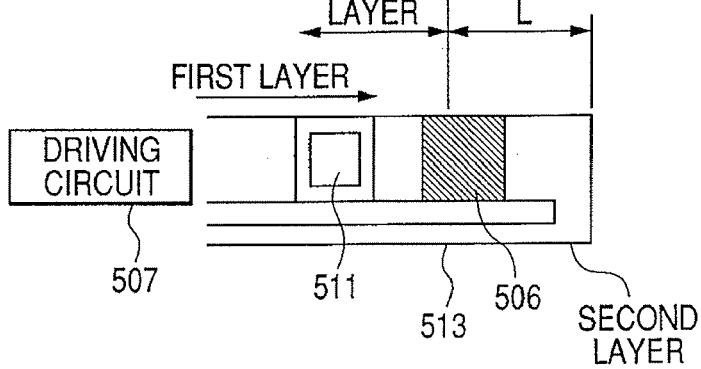

Next, referring to FIGS. 2A and 2B, description will be made of a point in which reduction in size of the substrate can be achieved by employment of the structure of the present invention. FIG. 2A is a schematic view for illustrating formation of an interlayer conductive portion in the recording head according to the present invention, and FIG. 2B is a schematic view for illustrating formation of an interlayer conductive portion according to an example of a conventional recording head.

Referring to FIG. 2A, in the case of this embodiment, an interlayer conductive portion 11 for conducting a wiring pattern 13*a* of a first layer and a wiring pattern 13*b* of a second layer is formed in a region indicated by the distance Lc by utilizing the fact that the distance Lc is extended. As a result, it is possible to dispose the recording element 6 and the driving circuit 7 to be closer to each other and to reduce the substrate 4 in size by a dimension L as compared with the prior art. In addition, there is known a method of providing a columnar member to a region indicated by the distance Lc so as to prevent foreign matters from entering the flow path from the ink supply opening. Also in this embodiment, the columnar member can be provided in the same manner, and can be more freely arranged because the region indicated by the distance Lc becomes wider.

The recording head according to this embodiment includes the driving circuit 7 brought into contact with the recording elements 6, for driving each recording element 6, a logical circuit for selecting the driving circuit 7, and a signal wiring portion communicating with an input portion of an end surface of the substrate. Accordingly, an interval between an ink supply opening 9 corresponding to the recording elements 6 for discharging a large liquid droplet and an ink supply opening 9 corresponding to the recording elements 6 for discharging a small liquid droplet is about 1.5 mm.

Figure 1B:
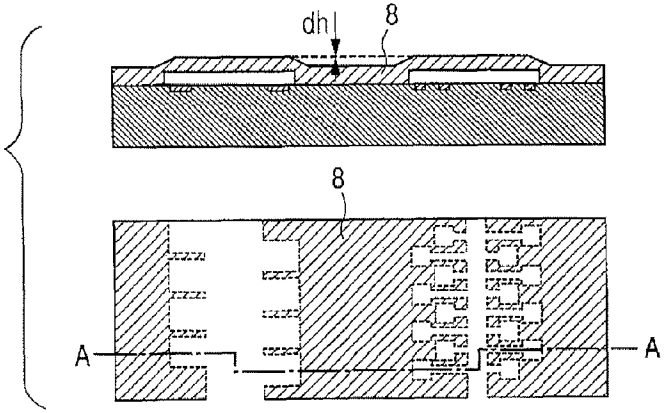

A pattern which becomes each flow path 10 is formed on the substrate 4, and then as illustrated in FIG. 1B, a flow path member 8 for forming outer walls of each flow path 10 and each discharge port 12 is further applied. As the flow path member 8, a negative-type photosensitive resin is generally used. A film thickness of the flow path member 8 is desirably set such that a resin thickness on each flow path 10 is about 10 μm. The film thickness of the flow path member 8 can be adjusted by the viscosity and the application speed. As illustrated in the cross-sectional view of FIG. 1B, the flow path member 8 has a difference in height between portions in which the flow path resin 5 to become a flow path 10 is formed, and the other portions thereof. As the region for the flow path 10 becomes narrower, the height of the flow path member 8 becomes lower, with the result that the resin thickness on the flow paths 10 becomes small. In this embodiment, the distance La and the distance Lb are set to be substantially the same, so the difference dh can be set to be extremely small.

Then, after application of the flow path member 8, the discharge ports 12 are formed by exposure and development, and the ink supply openings are formed by etching, thereby forming the recording head 1 (see FIG. 1C).

Figure 8C:
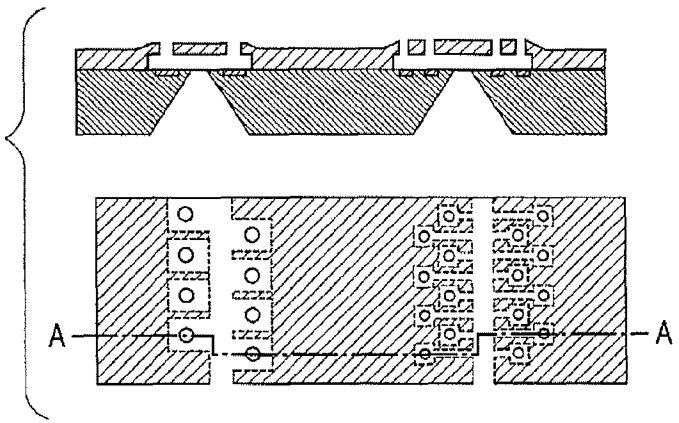
FIGS. 8A, 8B and 8C are schematic plan views for illustrating an example of multiple nozzle arrays in a prior art.
Figure 8A:
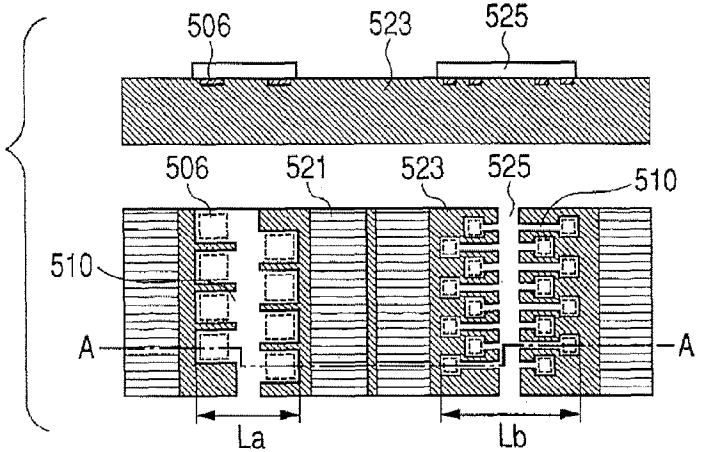
Figure 8B:
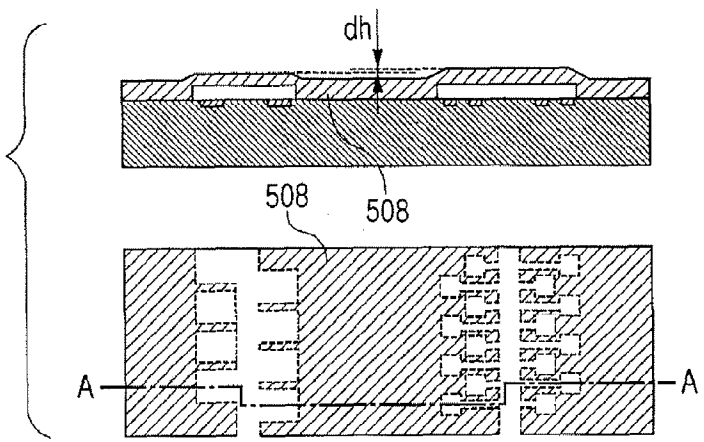

In the prior art illustrated in FIG. 8, the distance La is 280 μm, and the distance Lb is 360 μm which is about 1.3 times as long as the distance La, thereby generating the difference dh in thickness of the flow path member 8, which is 2 μm at maximum. This means that a difference in resistance of the discharge opening portions is 20% at maximum, which has adverse effects such as deviation of each impact position of small liquid droplets and large liquid droplets on a paper surface due to a difference between discharge speeds thereof, especially at the time of recording of a high resolution image.

However, according to this embodiment, the distance La and the distance Lb each of which is a distance between one outermost end of each flow path and the other outermost end thereof are set to be substantially the same, so it is possible to set the difference dh between the thickness of the flow path member 8 of the large liquid droplet flow path group 2 and that of the small liquid droplet flow path group 3, to be extremely small. For this reason, it is possible to set the difference in flow resistance of the discharge portion for large liquid droplets and that for small liquid droplets to be extremely smaller, and to prevent generation of adverse effects such as deviation of each impact position of small liquid droplets and large liquid droplets on a paper surface due to a difference between discharge speeds thereof. As a result, according to the recording head 1 of this embodiment, it is possible to form a high quality image.

Further, in the recording head 1 according to this embodiment, in order to set the distance La and the distance Lb to be substantially the same, the distance Lc between the flow path wall end 8*a* and the ink supply opening 9 is extended, thereby preventing lowering of the response frequency and enabling high speed recording.

In addition, the recording head 1 according to this embodiment is reduced in size by providing the interlayer conductive portion 11 by using the extended distance Lc.

It should be noted that recording elements for small liquid droplets are arranged in a staggered manner in this embodiment, but a part of, for example, a half of the recording elements for small liquid droplets, may be replaced by recording elements for medium-size liquid droplets within a range of about 2 pl to 3 pl in view of the balance between the high speed performance and the high quality.

Embodiment 2

Figure 3A:
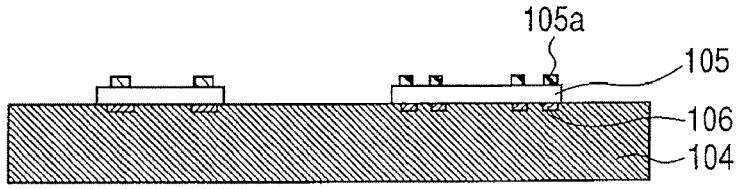
FIGS. 3A, 3B and 3C are cross-sectional diagrams of an ink jet recording head according to a second embodiment of the present invention, and each illustrates a process for forming the ink jet recording head.
Figure 3B:
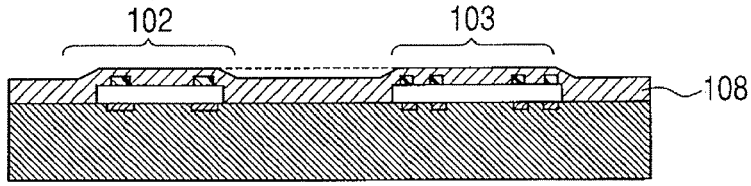
Figure 3C:
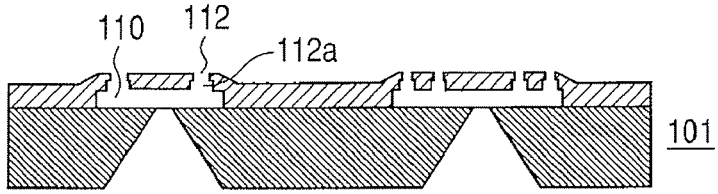

FIGS. 3A to 3C are process diagrams for illustrating a method of manufacturing a recording head according to a second embodiment of the present invention.

As illustrated in FIG. 3C, the recording head 101 according to this embodiment is characterized by including an enlarged portion 112*a*, which has a cross-sectional area larger than that of the discharge port 112, formed between a flow path 110 and the discharge port 112. By including the enlarged portion thus formed, it is possible to lower the resistance of the discharge port portion, thereby obtaining a nozzle having high efficiency and being capable of obtaining the same discharge energy as the prior art even when the size of the heating resistive element is made smaller than that of the prior art. In particular, in order to discharge small liquid droplets, it is necessary to set a diameter of the discharge port smaller. This structure is effective because the resistance of the discharge port portion is increased. In the structure with the enlarged portion 112*a*, the resin thickness in the vicinity of the discharge port becomes smaller, which causes large variation in performance due to variation of the applied thickness of the resin. When taking a demand for application with higher accuracy into consideration, the structure of the present invention is highly required. Note that the basic structure other than the above-mentioned different points is the same as that of the first embodiment, so detailed description thereof will be omitted.

First, as illustrated in FIG. 3A, a pattern of a flow path resin 105 is formed on a substrate 104 on which the recording elements 106 are formed, and a pattern of an enlarged portion resin 105*a* for forming the enlarged portion 112*a* is further formed on the flow path resin 105.

The flow path resin 105 made of a photosensitive resin was applied with a thickness of 14 μm, and the enlarged portion 112*a* made of a photosensitive resin was applied with a thickness of 5 μm. The flow path resin 105 and the enlarged portion 112*a* are separately subjected to exposure and development, thereby obtaining each desired shape. In order to prevent the flow path resin 105 from being affected at the time of exposure of the enlarged portion 112*a*, there is a method of, for example, selecting resins having different photosensitive wavelengths to perform exposure with different wavelengths, and of selecting a resin having a sensitivity higher than that of the flow path resin 105 to perform exposure with lower energy.

Then, as illustrated in FIG. 3B, the flow path member 108 on which outer walls of each flow path 110, the discharge ports 112, and the enlarged portions 112*a* are formed is applied.

Also in this embodiment, the distance La between one end of each flow path of a large liquid droplet flow path group 102 and the other end thereof is set substantially equal to the distance Lb between one end of each flow path of a small liquid droplet flow path group 103 and the other end thereof. For this reason, the difference in thickness of the resin of the flow path member 108 of the large liquid droplet flow path group 102 and that of small liquid droplet flow path group 103 can be set to be extremely small.

Finally, as illustrated in FIG. 3C, the flow path member 108 is subjected to exposure and development, thereby obtaining each final shape of the flow path 110, the discharge port 112 and the enlarged portion 112*a*. According to the method, the thickness of the discharge port can be set within a range of about 3 μm to 5 μm. For this reason, it is possible to reduce the resistance of the discharge port portion to a large extent as compared with a structure in which the enlarged portion 112*a* is not provided. It is difficult to adopt the structure including the enlarged portion 112*a* as in this embodiment because there is large fluctuation in discharge of ink when the variation of the resin thickness is large as in the prior art. However, in the case of this embodiment, the distance La and the distance Lb are set to be substantially equal to each other, so it is possible to set the variation in the resin thickness to be smaller, and thus it is possible to obtain the structure including the enlarged portion 112*a*.

Further, according to the structure of this embodiment, it is possible to obtain the same effects as those of the first embodiment, and to reduce the area for the recording elements with higher efficiency by reducing the resistance of the discharge port portion, which is especially effective for arrangement with higher density such as the staggered arrangement.

Embodiment 3

Figure 4C:
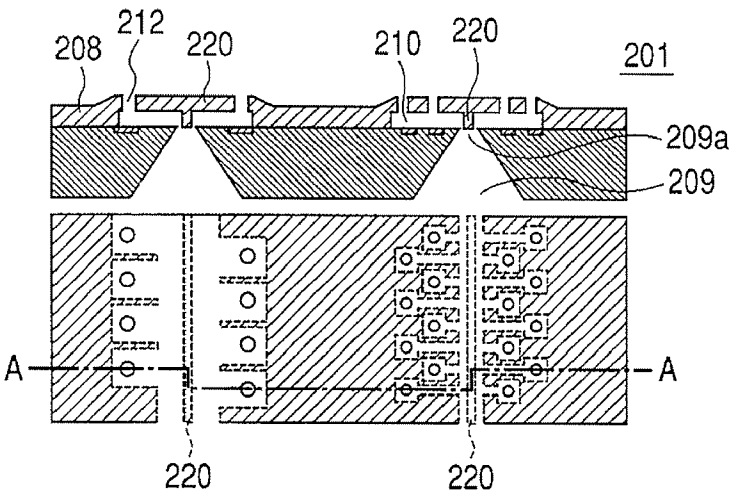
FIGS. 4A, 4B and 4C are plan views and cross-sectional diagrams taken along the line A-A of an ink jet recording head according to a third embodiment of the present invention, and each illustrates a process for forming the ink jet recording head.
Figure 4A:
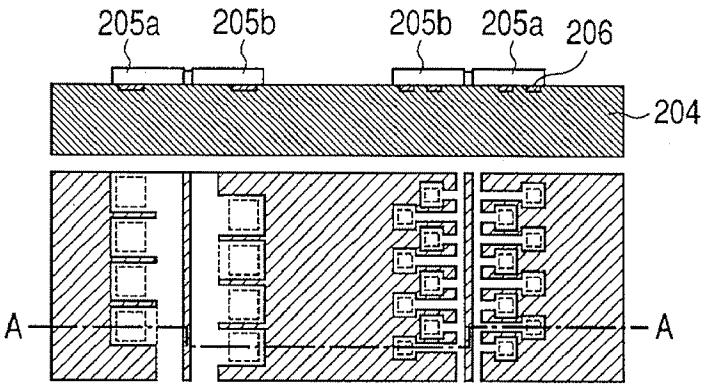
Figure 4B:
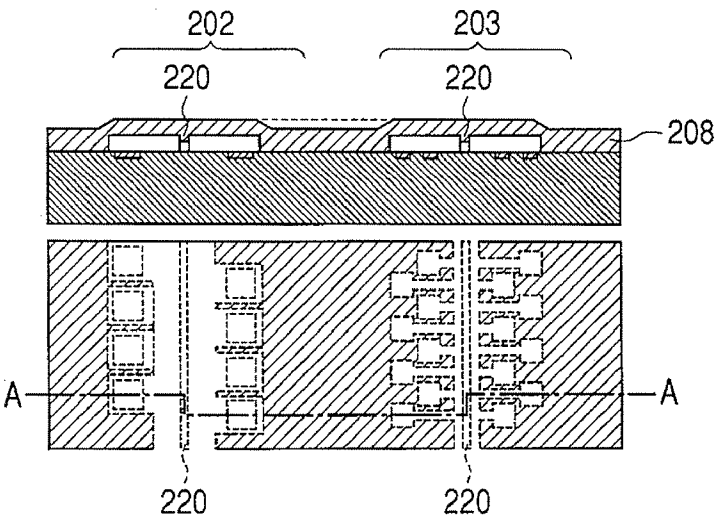

FIGS. 4A to 4C are process diagrams for illustrating a method of manufacturing a recording head according to a third embodiment of the present invention.

As illustrated in FIG. 4C, a recording head 201 of this embodiment is characterized by providing reinforcement portions 220 to portions corresponding to the opening portion 209*a* of each ink supply opening 209 of the flow path member 208. Note that the basic structure other than the above-mentioned different points is the same as that of the first embodiment, so detailed description thereof will be omitted.

First, as illustrated in FIG. 4A, on a substrate 204 in which recording elements 206 are formed, flow path resins 205*a* and flow path resins 205*b* are formed. In this case, the flow path resins 205*a* and the flow path resins 205*b* are each formed at a position corresponding to the opening portion 209*a* of each ink supply opening 209 to be formed in the substrate 204 at predetermined intervals between the flow path resin 205*a* and the flow path resin 205*b*.

Next, as illustrated in FIG. 4B, the flow path member 208 for forming outer walls of each flow path 210 and each discharge port 212 is applied. In this case, a predetermined interval is provided between the flow path resin 205*a* and the flow path resin 205*b*, so the flow path member 208 enters also the predetermined interval. An area of the predetermined interval for forming each reinforcement portion 220 is a smaller area than that of the entire flow path, which does not affect the resin thickness.

Also in this embodiment, the distance La between one end of each flow path of a large liquid droplet flow path group 202 and the other end thereof is set to be substantially equal to the distance Lb between one end of each flow path of a small liquid droplet flow path group 203 and the other end thereof. For this reason, the difference in thickness of the resin of the flow path member 208 of the large liquid droplet flow path group 202 and that of small liquid droplet flow path group 203 can be set to be extremely small.

Finally, as illustrated in FIG. 4C, the flow path member 208 is subjected to exposure and development, thereby obtaining each final shape of the flow path 210, the discharge port 212, and the reinforcement portion 220.

Each reinforcement portion 220 is formed at a position corresponding to the opening portion 209*a* of each ink supply opening 209 so as to make the thickness thereof larger than that of the other portions. In the flow path member 208, portions corresponding to each flow path 220 are not in contact with the substrate 204, so the portions are more liable to be deformed than the other portions. Especially in a case where each area of the portions is increased when the length of the nozzle array is increased, the deformation thereof is more liable to occur. The reinforcement portions 220 are provided so as to prevent the deformation.

As described above, according to the structure of this embodiment, it is possible to prevent deformation of the flow path member 208 and obtain the same effects as those of the first embodiment.

Embodiment 4

Figure 5A:
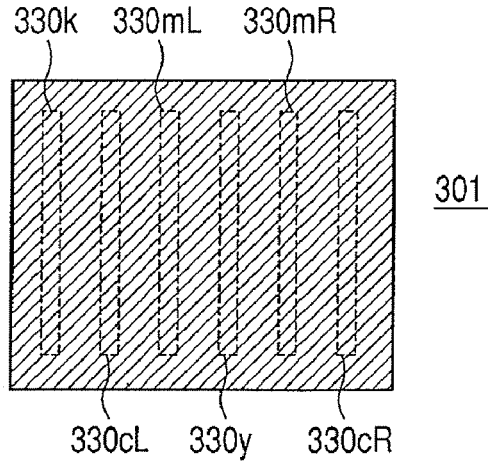
FIGS. 5A and 5B are plan views and cross-sectional diagrams taken along the line A-A of an ink jet recording head according to a fourth embodiment of the present invention.
Figure 5B:
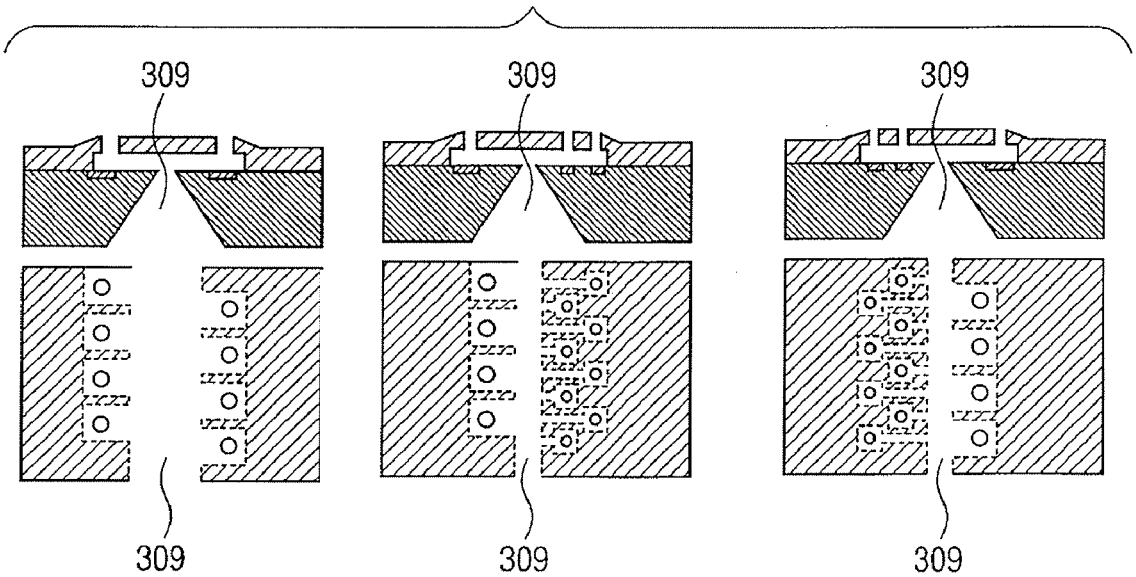

FIG. 5A is a schematic plan view of a recording head 301 according to a fourth embodiment of the present invention. Further, FIG. 5B illustrates a cross-sectional diagram and a plan view of nozzle arrays for each ink color. Basic structure according to this embodiment is the same as that of the first embodiment.

The recording head 301 according to this embodiment is capable of discharging ink for each color of black, cyan, magenta, and yellow. In the ink recording head 301, six nozzle arrays 330 including a black nozzle array 330*k*, a cyan nozzle array 330*c*L, a magenta nozzle array 330*m*L, a yellow nozzle array 330*y*, a magenta nozzle array 330*m*R, and a cyan nozzle array 330*c*R are formed in the stated order from the left side of FIG. 5A.

The cyan nozzle array 330*c*L and the cyan nozzle array 330*c*R, and the magenta nozzle array 330*m*L and the magenta nozzle array 330*m*R are arranged symmetrically as illustrated in FIG. 5B. Those nozzle arrays 330 are arranged such that 600 dpi nozzle arrays for discharging ink of 5 pl, and 1200 dpi nozzle arrays, in which discharge ports for discharging ink of 2.5 pl and discharge ports for discharging ink of 1.4 pl are arranged in a staggered manner, are arranged across an ink supply opening 309.

On the other hand, in the yellow nozzle array 330*y* and the black nozzle array 330*k*, there are provided discharge ports for discharging ink of 5 pl arranged at 600 dpi on both sides of the ink supply opening 309. The reason why nozzle arrays for small liquid droplets and medium-size liquid droplets are not provided for the yellow ink is that brightness of the yellow ink is higher than that of cyan and magenta inks, and there is little effect in improvement of image quality since the yellow ink originally has low granularity even in a case of large liquid droplets. In addition, with regard to the black ink, highest concentration of process black ink made of each ink of yellow, magenta, and cyan is low, and the black ink is used for the purpose of compensating for the insufficient concentration, which makes it unnecessary to provide nozzle arrays for medium-size liquid droplets and small liquid droplets.

In the structure of this embodiment, recording element density varies in each ink of black, yellow and cyan, and magenta. Accordingly, in order to prevent the resin thickness of discharge port portions for each ink of black and yellow from being smaller, the distance Lc for the nozzle arrays staggered at 1200 dpi was set to 40 μm, the distance Lc for the nozzle array arranged at 600 dpi was set to 82 μm for each ink of cyan, magenta, black, and yellow, and the distance La was set to be nearly equal to the distance Lb. With this structure, it is possible to obtain the same discharge performance and achieve the high quality image in all the colors and all the discharge liquid droplet sizes.

(Recording Apparatus)

Figure 6:
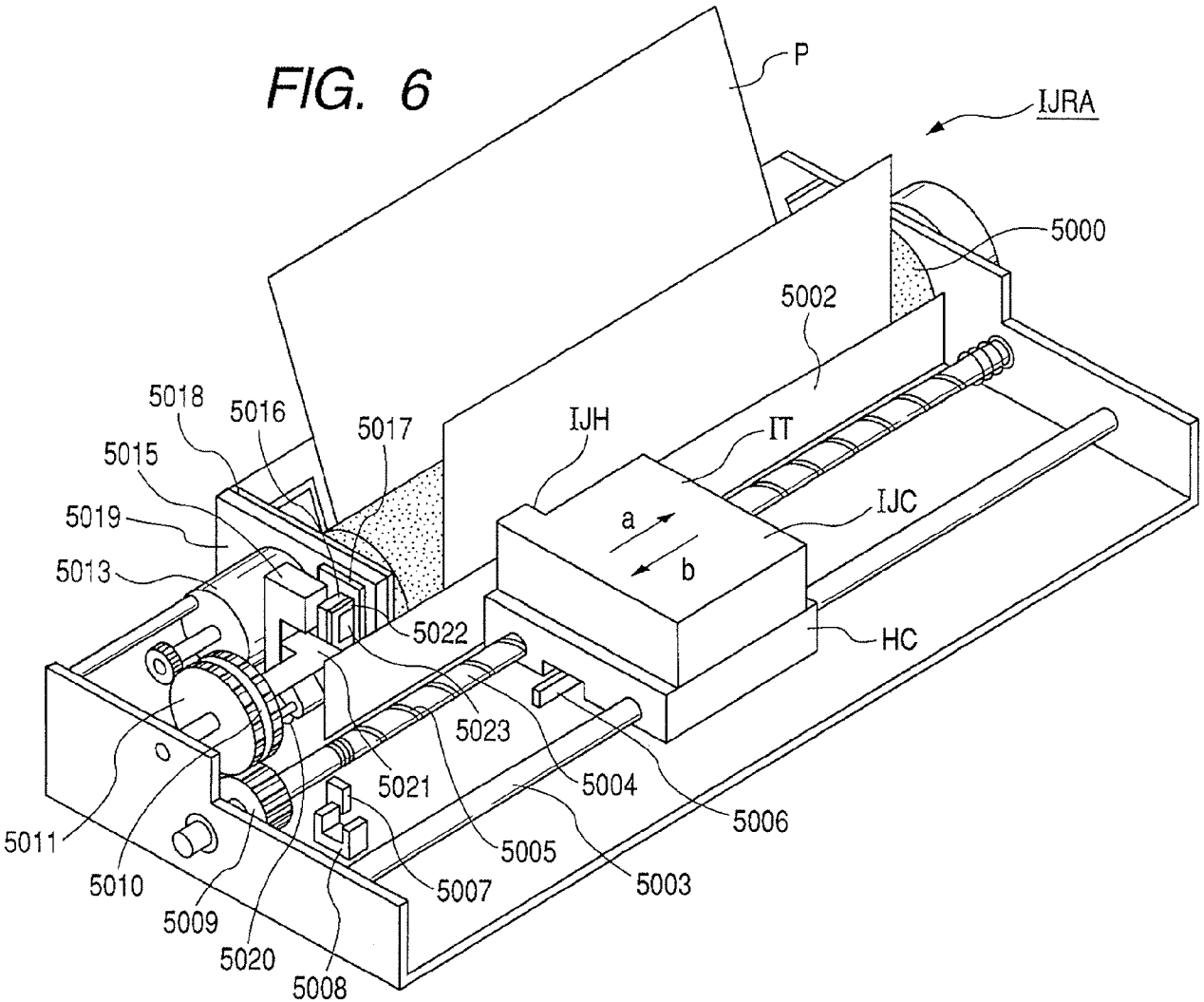
FIG. 6 is an appearance perspective view for illustrating an outline of a structure of an ink jet printer IJRA according to a representative embodiment of the present invention.

FIG. 6 is an appearance perspective view for illustrating an outline of a structure of an ink jet printer IJRA according to a representative embodiment of the present invention. In FIG. 6, a carriage HC engaged with helical channels 5005 of a lead screw 5004 which rotates through driving force transferring gears 5009 to 5011 in synchronization with forward and reverse rotation of a driving motor 5013 includes a pin (not shown). In the carriage HC which reciprocates in directions indicated by the arrows a and b while being supported by a guide rail 5003, an integrated ink jet cartridge IJC including a recording head IJH and an ink tank IT is mounted.

The recording head IJH is a recording head according to the above-mentioned embodiments. The recording head IJH has discharge ports for discharging ink toward a recording surface of a recording medium of a recording sheet P. The recording sheet P is conveyed with a conveyance mechanism, and recording is performed using ink discharged from the recording head IJH.

A sheet holding-down plate 5002 holds down the recording sheet P against a platen 5000 along a movement direction of the carriage HC. Photocouplers 5007 and 5008 are home position detecting devices for confirming presence of a lever 5006 of the carriage HC in this area, switching rotational direction of the motor 5013, and the like. A member 5016 supports a cap member 5022 for capping a front surface of the recording head IJH, and a suction device 5015 for sucking an inside of the cap and performing suction and recovery of the recording head through an inside-cap opening 5023. A cleaning blade 5017 can be moved in the forward and backward directions by a member 5019 and they are supported by a main body support plate 5018. The cleaning blade 5017 is not limited to this mode, and a well-known cleaning blade can also be applied to this. In addition, a lever 5021 is used for starting suction for the suction and recovery and is moved along with the movement of a cam 5020 which is engaged with the carriage HC, and a driving force from the driving motor is transferred and controlled by a known transfer mechanism such as switching of a clutch.

Those capping, cleaning, and suction and recovery operations are performed such that desired processing can be performed at corresponding positions by an action of the lead screw 5004 at the time when the carriage HC reaches a region on a side of the home position. However, as long as a desired operation is performed at a well-known timing, any structure can be applied.

(Description of Control Configuration)

Next, a control configuration for carrying out a control of recording by the above-mentioned apparatus will be described.

Figure 7:
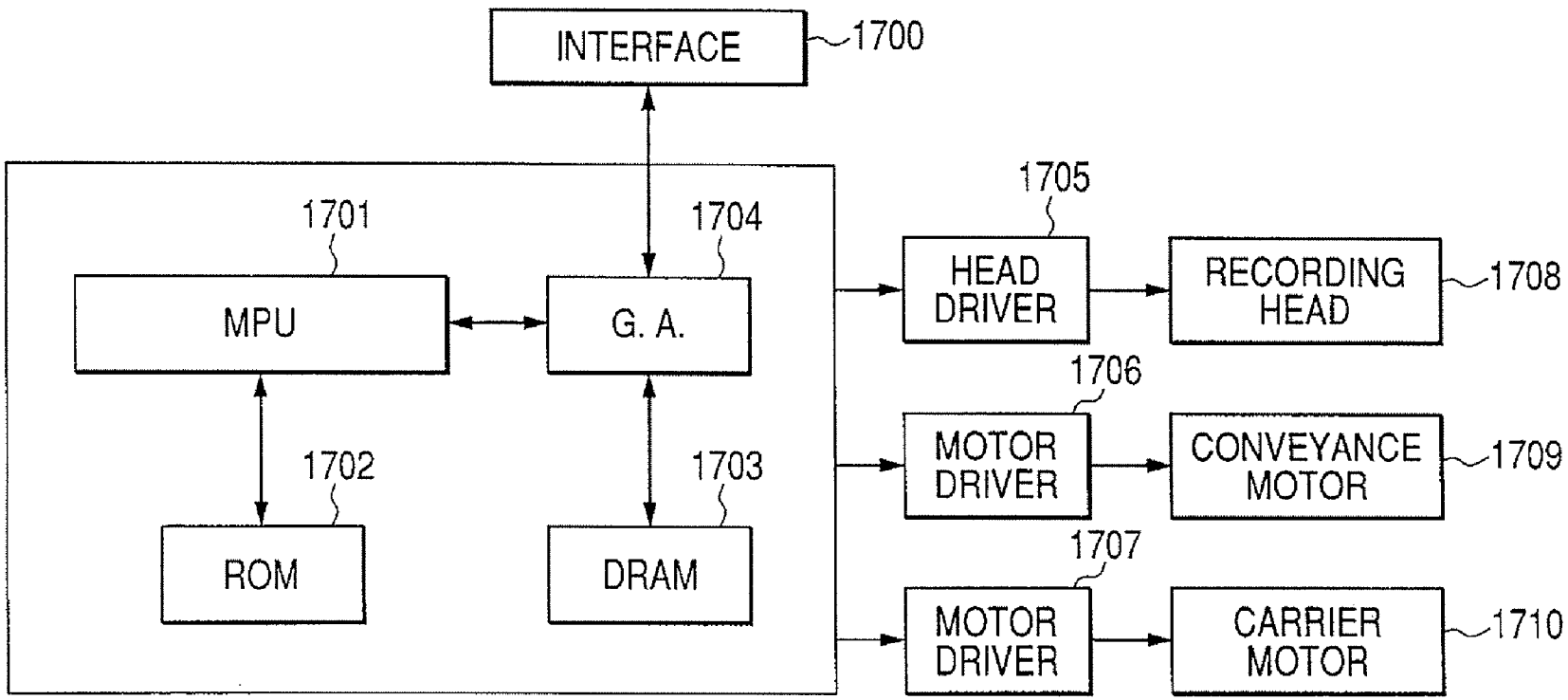
FIG. 7 is a block diagram for illustrating a configuration of a control circuit of the ink jet printer IJRA.

FIG. 7 is a block diagram for illustrating a configuration of a control circuit for an ink jet printer IJRA.

A recording signal is input to an interface 1700. A ROM 1702 is a ROM storing a control program executed by an MPU 1701, and a DRAM 1703 stores various pieces of data (e.g., the above-mentioned recording signal or recording data supplied to the recording head IJH). A gate array (G.A.) 1704 performs control of supplying recording data to the recording head IJH, and also performs control for data transfer between the interface 1700, the MPU 1701, and the RAM 1073. A carrier motor 1710 is a motor for conveyance of the recording head IJH, and a conveyance motor 1709 is a motor for conveyance of a recording sheet. A head driver 1705 is a driver for driving the recording head IJH, and motor drivers 1706 and 1707 are drivers for driving the conveyance motor 1709 and the carrier motor 1710, respectively.

Operations of the above-mentioned control configuration are described as follows. That is, when a recording signal is input to the interface 1700, the recording signal is converted into recording data for printing between the gate array 1704 and the MPU 1701. Then, the motor drivers 1706 and 1707 are driven and the recording head IJH is driven according to the recording data sent to the head driver 1705 to thereby perform recording.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-183256, filed Jul. 3, 2006, which is hereby incorporated by reference herein in its entirety.

What is claimed is:

1. An ink jet recording head, comprising:

a substrate on which a plurality of ink supply openings are formed;

a first recording element array formed of a plurality of recording elements arranged at a predetermined interval in rows on both sides of a first supply opening of said plurality of ink supply openings on said substrate so that said rows sandwich said first supply opening;

a second recording element array formed of, at least at one of both sides of a second supply opening of said plurality of ink supply openings, recording elements located relatively closer to said second supply opening and recording elements located relatively far from said second supply opening arranged in a staggered manner at an arrangement interval narrower than that of said recording elements of said first recording element array; and first and second ink flow path arrays formed of ink flow paths arranged in rows corresponding to said plurality of recording elements, for guiding ink from said ink supply openings to said recording elements, wherein said first ink flow path array corresponds to said first recording element array, and said second ink flow path array corresponds to said second recording element array, and wherein a distance (La) between one end portion of said ink flow paths and another end portion thereof across said first supply opening in said first ink flow path array is substantially equal to a distance (Lb) between one end portion of said ink flow paths corresponding to the recording elements located relatively far from said second supply opening and another end portion thereof across said second supply opening in said second ink flow path array.

2. An ink jet recording head according to claim 1, wherein a distance $Lc_1$ said first ink flow path array between one end portion thereof on a side wall of said first ink flow path and said ink supply opening is longer than a corresponding distance $Lc_2$ of said second ink flow path array.

3. An ink jet recording head according to claim 1, further comprising:

a wiring for supplying power to said recording elements formed on said substrate; and a conductive portion formed between said recording elements and said ink supplying openings, for conducting said wiring between interlayers, wherein said wiring comprises a multilayer wiring having at least two layers.

4. An ink jet recording head according to claim 1, wherein said first ink flow path array has discharge ports for discharging an ink droplets larger than those discharged from discharge ports of said second ink flow path array.

5. An ink jet head recording head according to claim 1, further comprising a communication portion for communicating discharge ports for discharging ink and said ink flow paths with each other, wherein said communication portion has an enlarged portion having a cross-sectional area larger than that of said discharge ports.

6. An ink jet recording head according to claim 1, further comprising:

a plurality of nozzle arrays for discharging cyan ink, magenta ink, yellow ink, and black ink, provided based on a size of ink droplets to be discharged, said nozzle arrays including said recording elements, said flow paths, and discharge ports for discharging ink, wherein said nozzle arrays for discharging the yellow ink and the black ink are formed of only nozzles for discharging a largest ink droplet.

7. An ink jet recording head according to claim 1, further comprising a flow path forming member for forming said flow paths, said flow path forming member made of a resin.

8. An ink jet recording head according to claim 1, wherein said recording elements each comprise an electrothermal transducing element for generating heat energy.

9. An ink jet recording apparatus, comprising:

a conveyance unit for conveying a recording medium; and an ink jet recording head according to claim 1 having discharge ports for discharging ink disposed facing a recording surface of the recording medium.

10. A method of manufacturing an ink jet recording head according to claim 1, said method comprising:

forming a first resin for forming said ink flow paths on said substrate; and forming a second resin for forming an enlarged portion on said first resin.

11. A method of manufacturing an ink jet recording head according to claim 10, wherein at least one of a member for forming said ink flow paths and a member for forming said enlarged portion having a cross-section larger than that of discharge ports comprises a photosensitive resin.

12. An ink jet recording head, comprising:

a substrate on which a plurality of ink supply openings are formed;

a first recording element array formed of a plurality of recording elements arranged at a predetermined interval in rows on both sides of a first supply opening of said plurality of ink supply openings on said substrate so that said rows sandwich said first supply opening;

a second recording element array formed of, at least at one of both sides of a second supply opening of said plurality of ink supply openings, recording elements located relatively closer to said second supply opening and recording elements located relatively far from said second supply opening arranged in a staggered manner at an arrangement interval narrower than that of said recording elements of said first recording element array; and first and second ink flow path arrays formed of ink flow paths arranged in rows corresponding to said plurality of recording elements, for guiding ink from said ink supply openings to said recording elements, wherein said first ink flow path array corresponds to said first recording element array, and said second ink flow path array corresponds to said second recording element array, and wherein an ink flow path across said first ink supply opening in said first ink flow path array is extended so that a distance (La) between one end portion of said ink flow path and another end portion thereof across said first supply opening is substantially equal to a distance (Lb) that is longest among distances between one end portion of said ink flow paths corresponding to a recording elements located relatively far from said second supply opening and another end portion thereof across said second supply opening in said second ink flow path array.

13. An ink jet recording head, comprising:

a substrate on which a plurality of ink supply openings are formed;

a first recording element array formed of a plurality of recording elements arranged at a predetermined interval in rows on both sides of a first supply opening of said plurality of ink supply openings on said substrate so that said rows sandwich said first supply opening;

a second recording element array formed of, at one of both sides of a second supply opening of said plurality of ink supply openings, recording elements located relatively closer to said second supply opening and recording elements located relatively far from said second supply opening arranged in a staggered manner at an arrangement interval narrower than that of said recording elements of said first recording element array; and first and second ink flow path arrays formed of ink flow paths arranged in rows corresponding to said plurality of recording elements, for guiding ink from said ink supply openings to said recording elements, wherein said first ink flow path array corresponds to said first recording element array, and said second ink flow path array corresponds to said second recording element array, and wherein a distance (La) between one end portion of said ink flow paths and another end portion thereof across said first supply opening in said first ink flow path array is substantially equal to a distance (Lb) between one end portion of said ink flow paths corresponding to recording elements located relatively far from said second supply opening and one end portion of said ink flow path corresponding to recording elements located relatively far from said second supply opening at both sides across said second supply opening in said second ink flow path array.

* * * * *